US005687701A

United States Patent [19]

Henry

[11] Patent Number: 5,687,701

[45] Date of Patent: Nov. 18, 1997

[54] ARCHERY BOW SAFETY LOCK

[76] Inventor: Charles A. Henry, 4554 Malden Road, Windsor, Ontario, Canada, N9E 3T1

[21] Appl. No.: 664,910

[22] Filed: Jun. 17, 1996

[51] Int. Cl.[6] ..... F41B 5/00; E05B 73/00

[52] U.S. Cl. ..... 124/1; 124/23.1; 124/86; 70/18; 70/58; D8/333; D8/339

[58] Field of Search ..... 124/1, 23.1, 86, 124/88; 70/14, 16, 17, 18, 19, 57, 58, 233; D8/333, 339

[56] References Cited

U.S. PATENT DOCUMENTS

| | | | |
|---|---|---|---|
| 337,183 | 3/1886 | Merrill | 70/19 X |
| 596,237 | 12/1897 | Damon | 70/233 X |
| 3,805,564 | 4/1974 | Velardo | 70/18 |
| 4,216,665 | 8/1980 | McKelvey | 70/58 |
| 5,076,531 | 12/1991 | Delaney | 70/58 X |

*Primary Examiner*—John A. Ricci

[57] ABSTRACT

The present invention is directed to an Archery Bow safety lock for releasable attachment to an Archery Bow to prevent operation of the bow when the lock is attached. The safety lock comprises a containment region to contain a bow string and prevent the bow string from being drawn or removed from the containment region when the lock is attached to the bow and a means for releasably securing the lock to the handle or riser region of the bow. The safety lock allows the bow string to be inserted into the containment region. The lock is also able to pass through or around the handle or riser region and thereafter be secured to prevent operation of the bow.

10 Claims, 3 Drawing Sheets

ARCHERY BOW SAFETY LOCK

FIELD OF THE INVENTION

The present invention relates to an Archery Bow safety lock, and more particularly to an Archery Bow lock structured to restrict the pulling back (commonly known as drawing back) of the bow string to prevent operation of the bow.

BACKGROUND OF THE INVENTION

Over the years, the popularity of sport hunting and competition shooting employing different types of arms, usually Guns (Firearms) and Bows as used in Archery, has grown significantly. In recent years, locking means have been employed on guns when they are not in use to help ensure that they cannot be discharged by someone other than the owner or operator to help avoid any undue injury.

For example, U.S. Pat. Nos. 91,563 entitled "Lock for Firearms" and 4,198,026 entitled "Firearm Security Device" along with Canadian Patent number 1,197,719 entitled "Firearm Safety Apparatus" depict various ways of locking or securing a gun's firing mechanism so that it is unable to fire.

While there have been many locking devices developed for firearms, the applicant is unaware of any such locking device for Archery Bows.

It is the object of the present invention to provide a means of restricting the bow string on an Archery Bow from being pulled back. When you restrict the movement of the bow string on an Archery Bow, and hence the use of the Archery Bow, you render the bow inoperable. When you render the Archery Bow inoperable, it no longer poses a safety concern when left unattended.

SUMMARY OF THE INVENTION

The present invention is directed to an Archery Bow safety lock for releasable attachment to an Archery Bow to prevent operation of the bow when the lock is attached. The safety lock comprises a containment region to contain a bow string and prevent the bow string from being drawn or removed from the containment region when the lock is attached to the bow and a means for releasably securing the lock to the handle or riser region of the bow. The safety lock allows the bow string to be inserted into the containment region. The lock is also able to pass through or around the handle or riser region and thereafter be secured to prevent operation of the bow.

In an aspect of the invention, the safety lock is elliptical or obround having an opening in one long side to permit the bow string and handle or riser to pass therethrough and be contained within a first and second end respectively.

In another aspect of the invention, the safety lock is provided with a handle or riser engaging member having an end capable of passing through an opening in the handle or riser of the bow.

BRIEF DESCRIPTION OF THE DRAWINGS

Preferred embodiments of the Archery Bow safety lock of the present invention are illustrated in the accompanying drawings, in which.

DETAILED DESCRIPTION OF THE PREFERRED EMBODIMENTS

Figure 1:
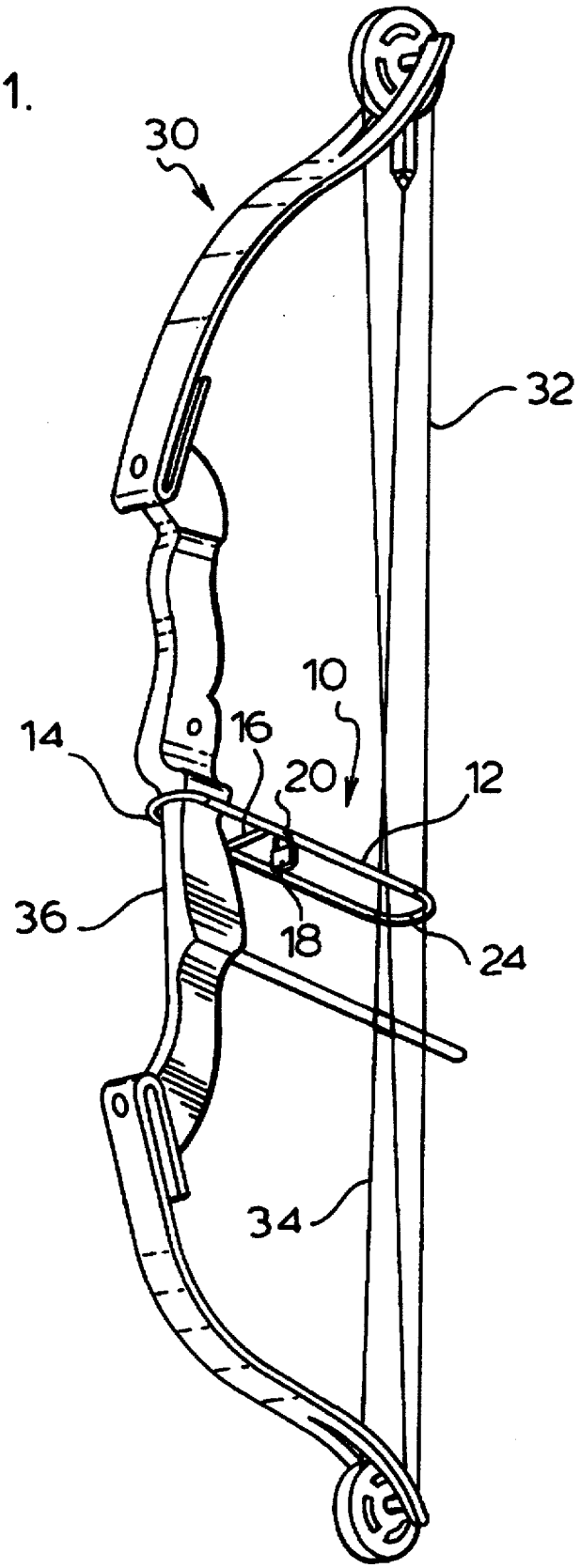
FIG. 1 is a side view of a compound bow with a first embodiment of a bow lock, according to the present invention, fastened to it.
Figure 2:
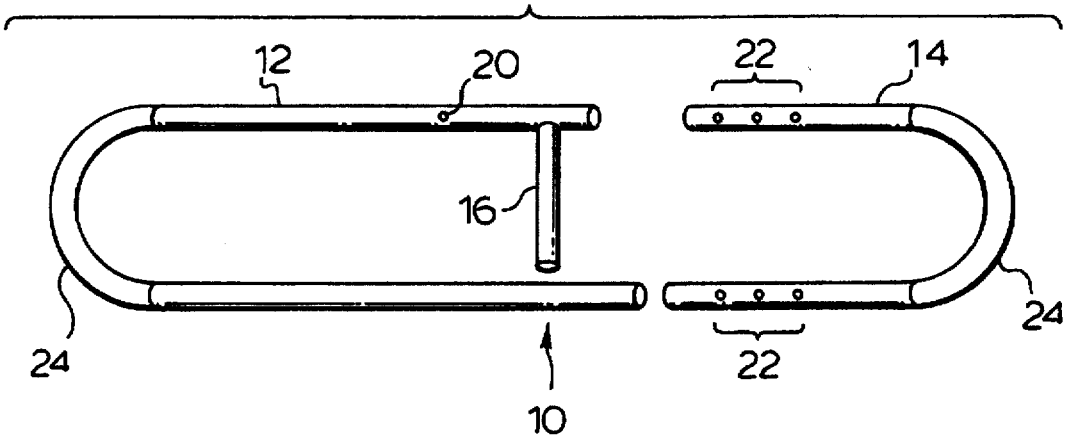
FIG. 2 is a view of the two piece bow lock of FIG. 1.

The present invention provides for a safety lock for an Archery Bow. The safety lock, when attached to the bow, restricts the pulling back or drawing back of the bow string to prevent operation of the bow. A first embodiment of the safety lock of the present invention is illustrated in FIGS. 1 and 2, generally indicated by the numeral 10. Safety lock 10 attaches to a bow such as a compound bow 30, illustrated in FIG. 1, by attaching to the handle or riser area of the bow. The lock 10 may be positioned anywhere on the compound bow from the overdraw down to the end of the riser with a preferred place being that of the handle grip area. Bow lock 10 is provided with a containment region to contain a bow string and prevent the bow string from being drawn or removed from the containment region when the lock is attached to the bow. In the embodiment illustrated in FIG. 1, the lock 10 is elliptical or obround in shape with the bow string containment region being located in the first end and the second end surrounding and containing the handle grip area of the bow riser.

The first embodiment of the bow lock 10 of the present invention is illustrated in further detail in FIG. 2. Bow lock 10 is comprised of two U-shaped members 12 and 14 which fit together to provide for the elliptical or obround shape of the bow lock 10. Bow lock 10 on one long side of member 12 is provided with an extending member or push bar 16 which extends most of the way across the lock, but has an opening between the end of the push bar 16 and the second long side of the first member 12. This opening allows the bow string 32 and cables 34 to pass through the opening and into the bow string containment region encompassed by the loop of member 12. Preferably, push bar 16 is positioned such that when the lock 10 is installed on the bow 30, push bar 16 will fit snugly against the handle grip area 36 of the bow 30.

The two members 12 and 14 of the bow lock 10 are provided with line up holes 20 and 22 for attachment of a suitable locking means 18. Holes 20 and 22 may be provided such that when the two members 12 and 14 are slid together on the bow, the holes 20 and 22 line up such that a locking means may be inserted through the two holes 20 and 22. Alternatively, holes 20 and 22 on the members may be provided such that they do not line up but a suitable locking means may be inserted through each of holes 20 and 22 individually and the locking means, locking members 12 and 14 together.

Bow lock 10 is preferably provided with a protective covering 24 on opposite ends of the bow lock 10 as well as on the push bar 16. Protective covering 24 is preferably made of a material which has a surface having a coefficient of friction that will reduce the tendency of the lock to slide along the handle grip. The provision of the protective covering 24 from a material, such as a suitable rubber, helps ensure a proper fit of the lock 10 as well as protecting the handle and string from damage by the lock 10.

Figure 3:
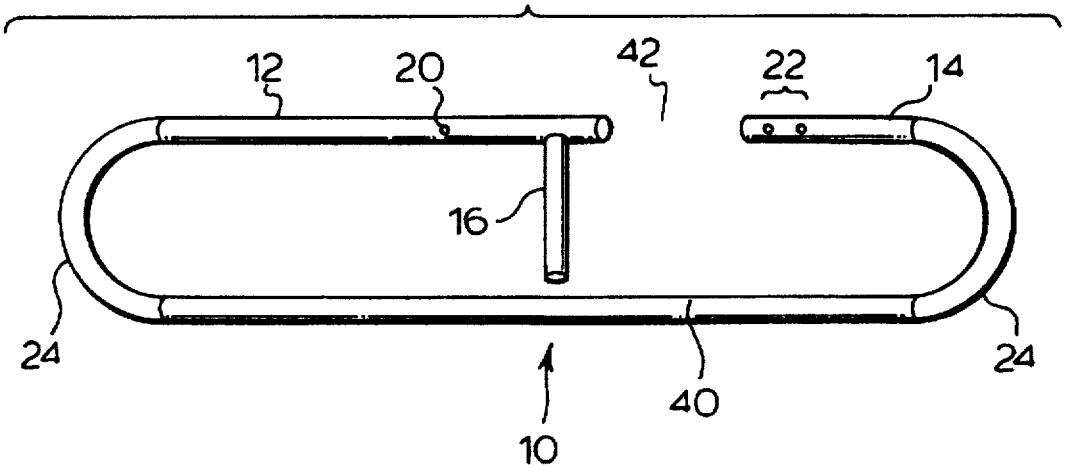
FIG. 3 is a view showing a second embodiment of the lock of the present invention, a one piece bow lock.

FIG. 3, shows a one piece variation of the bow lock 10. U-shaped member 12 and 14 are joined together at a closed end 40 and have an open end 42 which is large enough to allow the bow string 32, cables 34 and handle or riser 36 of a compound bow 30 (refer to FIG. 1) to pass through. Member 12 has a push bar 16 that extends from one of its sides with an opening, a line-up hole 20, and a protective covering 24 on its closed end, and push bar 16. Member 14 has multiple line-up holes 22 and a protective covering 24 on its closed end.

While FIG. 3 illustrates that the one piece variation of the bow lock 10 may be produced by permanently joining together members 12 and 14, such a one piece bow lock may also be produced from a single piece of suitable material bent or formed into the proper shape.

Figure 4:
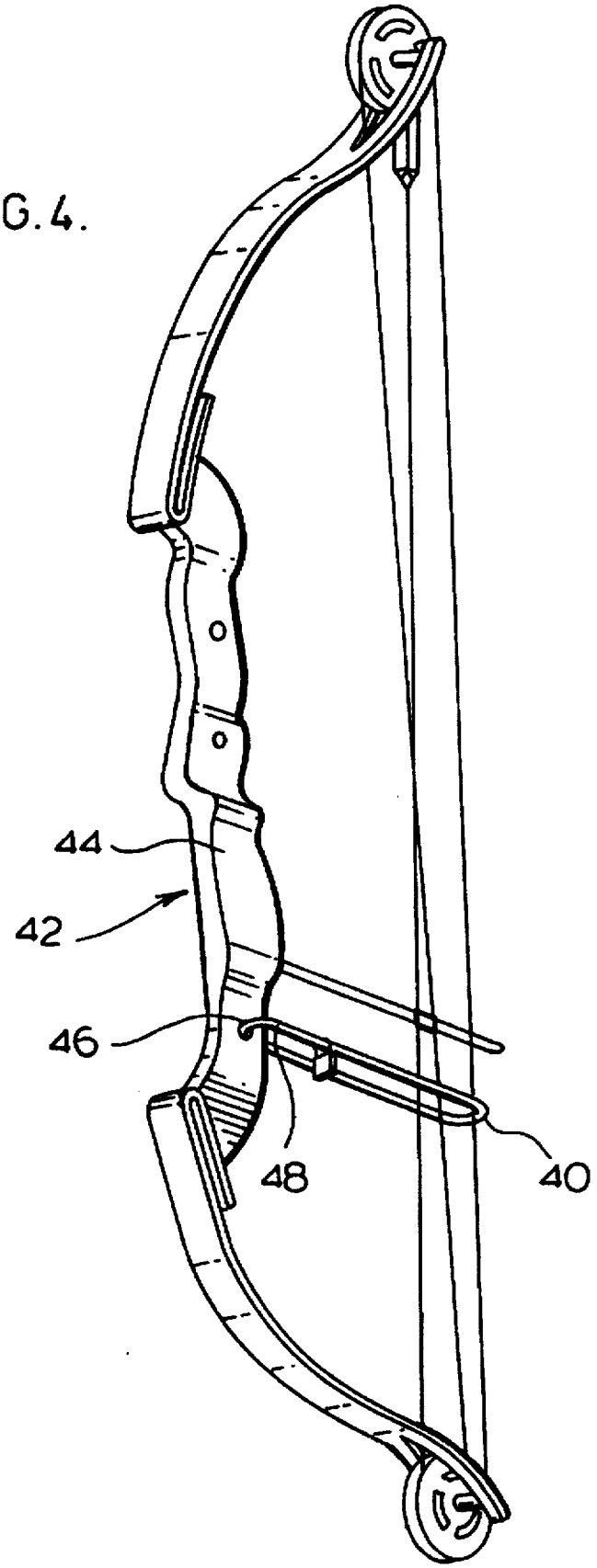
FIG. 4 is a side view of a compound bow with a third embodiment of a bow lock, according to the present invention, attached to it.

A further embodiment of the safety lock 40 of the present invention is illustrated in FIG. 4 attached to a compound bow 42. This compound bow 42 has a riser or handle 44 which is provided with openings 46, either provided after casting of the riser 44 for attachment of accessories or the openings 46 are formed during the machining of the riser 44. Such openings are common in lightweight risers. The lock 40 is provided with a locking member 48 which passes through the opening 46 in the riser 44 to lock the lock 40 to the riser 44. Locking member 48, to pass through the opening 46 in the handle or riser 44 of the bow 42, may be provided as a straight member with provision on its end for attachment of a locking means, such that when the locking means is attached the locking member 48 may not be withdrawn back through the opening 46. Alternatively, the locking member 48, to pass through the opening, may be shaped similar to that of the first embodiment of the bow lock illustrated in FIG. 2, whereby member 14 is passed through the opening in the riser, member 12 is attached to contain the bow strings within the containment region and the two parts of the bow lock are locked together, similar to that of the first embodiment. If the locking member 48 is provided as a straight member which goes through the opening 46 in the riser 44 with the locking means being attached directly to the end of this member 48 then such a bow lock 40 is preferable a one piece bow lock formed by bending or forming the lock from a suitable single piece of stock. The other features of the lock such as the containment region for the bow strings and the push bar are similar to that of the previous embodiments.

Accordingly, in the present invention there is provided a lock, made of a material suitable for securing purposes, that will fit around the circumference of a compound Archery Bow. The lock may be positioned anywhere on a compound bow from the overdraw down to the end of the riser, with the preferred placement being that of the handle/grip area. The bow lock encompasses the handle/grip area, bow string and cables of a compound bow and in a preferred embodiment has a bar that fits snug against the handle/grip area to help keep it in place. There is a protective covering on the bar and the closed ends of the bow lock. The protective covering helps the bow lock stay in position and will help avoid any damage to the bow. When you attach the bow lock to an Archery Bow you restrict the movement of the Archery Bow string. If you are unable to pull the bow string back far enough, you are unable to shoot an arrow with the bow. Thus, you render the bow inoperable and the Archery Bow now no longer poses a safety concern when not in use or left unattended.

Although various preferred embodiments of the present invention have been described herein in detail, it will be appreciated by those of skill in the art that variations may be made thereto without departing from the spirit of the invention of the scope of the appended claims.

I claim:

1. An Archery Bow lock for releasable attachment to an Archery Bow to prevent operation of the bow when the lock is attached comprising:

an elliptical or obround body having a containment region to contain a bow string and prevent the bow string from being drawn or removed from the containment region when the lock is attached to the bow located at a first end of the bow lock, and a means to releasably secure the lock to the handle or riser region of the bow located at a second end of the bow lock, the elliptical or obround body having an opening in one long side to permit the bow string to pass therethrough and be contained within the containment region in the first end of the bow lock and the handle or riser region of the bow being able to pass through the opening and be contained within the second end of the bow lock, the bow lock being provided with a member attached to the one long side between the opening and the first end and extending most of the way across the lock to permit the bow string to pass between the end of the member and a second long side of the lock and thereafter be contained in the containment region in the first end of the lock.

2. An Archery Bow safety lock as claimed in claim 1 wherein the member, attached to the one long side, is positioned on the one long side and the member will rest against the riser when the lock is attached to an Archery Bow.

3. An Archery Bow lock as claimed in claim 1 wherein the opening in the one long side is closed by a locking means to secure the lock to an Archery Bow.

4. In combination, an Archery Bow comprising a handle or riser region for gripping of the bow, arms attached at a first end and extending from both ends of the handle or riser region, and a bow string extending between second ends of the arms, and an Archery Bow safety lock releasably attached to the Archery Bow to prevent operation of the bow when the lock is attached, said combination comprising:

a containment region of the lock containing the bow string and preventing the bow string from being drawn or removed from the containment region, a means releasably securing the lock to the handle or riser region of the bow, the lock being able to be attached to and released from the bow by allowing the bow string to be inserted into or removed from the containment region and the lock also being able to pass through or around the handle or riser region of the bow and thereafter be secured to the bow to prevent operation of the bow.

5. The combination of an Archery Bow and an Archery Bow safety lock as claimed in claim 4 wherein the bow lock is elliptical or obround, having an opening in one long side through which the bow string and handle or riser passes to be contained within a first and second end respectively.

6. The combination of an Archery Bow and an Archery Bow safety lock as claimed in claim 5 wherein the bow lock is provided with a member attached to the one long side between the opening and the first end and extending most of the way across the lock to permit the bow string to pass between the end of the member and a second long side of the lock and thereafter be contained in the containment region in the first end of the lock.

7. The combination of an Archery Bow and an Archery Bow safety lock as claimed in claim 6 wherein the member, attached to the one long side, is positioned on the one long side and the member rests against the riser of the bow.

8. The combination of an Archery Bow and an Archery Bow safety lock as claimed in claim 7 wherein the opening in the one long side is closed by a locking means to secure the lock to the Archery Bow.

9. The combination of an Archery Bow and an Archery Bow safety lock as claimed in claim 4 wherein the lock is provided with a member having an end which passes through an opening in the handle or riser of the bow.

10. The combination of art Archery Bow and an Archery Bow safety lock as claimed in claim 9 wherein the end of the member is provided with a means for accepting a locking means to secure the lock to the handle or riser.

* * * * *